US006137450A

United States Patent [19]

Bhattacharyya et al.

[11] Patent Number: 6,137,450

[45] Date of Patent: Oct. 24, 2000

[54] DUAL-LINEARLY POLARIZED MULTI-MODE RECTANGULAR HORN FOR ARRAY ANTENNAS

[75] Inventors: Arun K. Bhattacharyya, El Segundo; Sudhakar K. Rao, Torrance, both of Calif.

[73] Assignee: Hughes Electronics Corporation, El Segundo, Calif.

[21] Appl. No.: 09/286,379

[22] Filed: Apr. 5, 1999

[51] Int. Cl.[7] ..... H01Q 13/00

[52] U.S. Cl. ..... 343/786; 343/776

[58] Field of Search ..... 343/786, 776, 343/772, 777, 778

[56] References Cited

U.S. PATENT DOCUMENTS

| | | | |
|---|---|---|---|
| 3,821,741 | 6/1974 | D'Oro et al. | 343/117 R |
| 4,442,437 | 4/1984 | Chu et al. | 343/786 |
| 4,731,616 | 3/1988 | Fulton et al. | 343/786 |
| 4,749,970 | 6/1988 | Rammos | 333/125 |
| 4,757,326 | 7/1988 | Profera, Jr. | 343/786 |
| 4,764,775 | 8/1988 | Craven | 343/786 |
| 4,792,814 | 12/1988 | Ebisui | 343/786 |
| 4,797,681 | 1/1989 | Kaplan et al. | 343/786 |
| 4,897,663 | 1/1990 | Kusano et al. | 343/786 |
| 4,903,038 | 2/1990 | Massey | 343/786 |
| 5,117,240 | 5/1992 | Anderson | 343/786 |

*Primary Examiner*—Don Wong
*Assistant Examiner*—Trinh Vo Dinh
*Attorney, Agent, or Firm*—T. Gudmestad; M. Sales

[57] ABSTRACT

A dual-linearly polarized multi-mode rectangular horn includes a step junction in each of the two orthogonal planes for producing a desired amount of the higher order $TE_{30}$ mode signal along with the dominant order $TE_{10}$ mode signal for both of the vertical and horizontal polarization signals. The rectangular horn further includes a phasing section in each of the two orthogonal planes for causing the $TE_{30}$ mode signal to be a desired amount of degrees out of phase with the $TE_{10}$ mode signal at the aperture plane of the rectangular horn for both of the vertical and horizontal polarization signals. The rectangular horn is for use in a reconfigurable satellite array antenna.

12 Claims, 4 Drawing Sheets

DUAL-LINEARLY POLARIZED MULTI-MODE RECTANGULAR HORN FOR ARRAY ANTENNAS

TECHNICAL FIELD

The present invention relates generally to horn antennas and, more particularly, to a dual-linearly polarized multi-mode rectangular horn for satellite array antennas.

BACKGROUND ART

Horns are used as radiating elements in array antennas for fixed satellite service payloads. Typical fixed satellite service array antennas operate over fixed coverage regions using dual-linear polarizations. These array antennas are typically required to meet cross-polar isolation requirements of at least 30 dB over a relatively narrow bandwidth of 500 MHZ. However, there exists a need for array antennas having greater flexibility in terms of changing beam locations and/or reconfiguring beam shapes on orbit over a relatively higher bandwidth of 2000 MHZ to provide global reconfigurability.

A direct radiating array having a reconfigurable beam forming network is an ideal candidate for reconfigurable array antennas. In order to provide global reconfigurability, the array antenna has to scan roughly +/−9° without the appearance of grating lobes in the visible angular region from the geostationary orbit of the satellite. A hexagonal grid arrangement of the radiating elements is preferred due to the reduction in the number of elements (about 15%) when compared with a square grid layout. A radiating element size on the order of three wavelengths is a desirable choice for minimizing the number of elements in the array antenna and pushing the grating lobes outside the +/−9° field of view.

Using dual-mode circular horns as the radiating elements is undesirable because of limited bandwidth. Corrugated horns provide the necessary bandwidth but are not efficient when placed in an array because of wall thickness. Square horns provide the necessary bandwidth and meet the cross-polar requirements but are not suitable for the hexagonal grid arrangement.

Thus, there is a need for a rectangular horn suitable for use in an array antenna for dual-linearly polarized applications. Further, because the array antenna efficiency is improved by using multi-mode horns instead of dominant horns, there also exists a need for the rectangular horn to provide multi-modes.

Typical multi-mode rectangular/square horns use a step junction in one plane for supporting a single linear polarization, for instance, vertical polarization. The performance of these rectangular/square horns for the horizontal polarization is poor because the step junction is in the horizontal plane. In general, the multi-mode horns reported in the literature are efficient for an H-plane step junction but cannot be used for dual-linearly polarized applications.

DISCLOSURE OF INVENTION

Accordingly, it is an object of the present invention to provide a dual-linearly polarized multi-mode rectangular horn.

It is another object of the present invention to provide a dual-linearly polarized multi-mode rectangular horn having a step junction in each of the two orthogonal planes for producing a desired amount of the higher order $TE_{30}$ mode signal along with the dominant order $TE_{10}$ mode signal for both of the vertical and horizontal polarization signals.

It is a further object of the present invention to provide a dual-linearly polarized multi-mode horn having a phasing section in each of the two orthogonal planes for causing the $TE_{30}$ mode signal to be a desired amount of degrees out of phase with the $TE_{10}$ mode signal at the aperture plane of the horn for both of the vertical and horizontal polarization signals.

It is still another object of the present invention to provide a dual-linearly polarized multi-mode rectangular horn for use in a reconfigurable satellite array antenna.

It is still a further object of the present invention to provide a dual-linearly polarized multi-mode rectangular horn having a bandwidth of at least 2000 MHZ for each of the vertical and horizontal polarization signals.

It is still yet another object of the present invention to provide a dual-linearly polarized multi-mode rectangular horn having at least a 30 dB cross-polar isolation.

It is still yet a further object of the present invention to provide a dual-linearly polarized multi-mode rectangular horn such that the ratio of the peak electric field intensity values of the $TE_{10}$ and $TE_{30}$ mode signals is about 3:1 in each of the two orthogonal planes.

It is still yet another object of the present invention to provide a dual-linearly polarized multi-mode rectangular horn such that the differential phase between the $TE_{10}$ and $TE_{30}$ mode signals is about 180° in each of the two orthogonal planes at the aperture plane of the horn.

In carrying out the above objects and other objects, the present invention provides a dual-linearly polarized multi-mode rectangular horn for an array antenna. The rectangular horn includes a flared waveguide section having first and second pairs of opposed walls and a phasing section having first and second pairs of opposed walls. The flared waveguide section provides separate vertical and horizontal polarization $TE_{10}$ mode signals. The first and second pairs of opposed walls of the phasing section form an aperture plane. Each one of a first pair of step junctions connects a respective one of the first pair of opposed walls of the phasing section to a respective one of the first pair of opposed walls of the flared waveguide section. The first pair of step junctions have a selected height such that interaction with the vertical polarization $TE_{10}$ mode signal causes a desired amount of a vertical polarization $TE_{30}$ mode signal to be generated from the vertical polarization $TE_{10}$ mode signal to form a combined vertical polarization signal. Each of a second pair of step junctions connects a respective one of the second pair of opposed walls of the phasing section to a respective one of the second pair of opposed walls of the flared waveguide section. The second pair of step junctions have a selected height such that interaction with the horizontal polarization $TE_{10}$ mode signal causes a desired amount of a horizontal polarization $TE_{30}$ mode signal to be generated from the horizontal polarization $TE_{10}$ mode signal to form a combined horizontal polarization signal. The phasing section receives the combined vertical and horizontal polarization signals for transmission at the aperture plane.

Further, in carrying out the above objects and other objects, the present invention provides an array antenna having a plurality of the rectangular horns.

These and other features, aspects, and embodiments of the present invention are described in more detail in the following description, appended claims, and accompanying drawings.

BEST MODE FOR CARRYING OUT THE INVENTION

Although the term transmit has been used in various places herein, those skilled in the art will recognize that reciprocity dictates an identical or at least similar operation in a receive mode. Therefore, the term transmit is used in those instances only for convenience of description and may in fact include the operation of receive. Likewise, the term radiative may also include receptive.

Figure 1A:
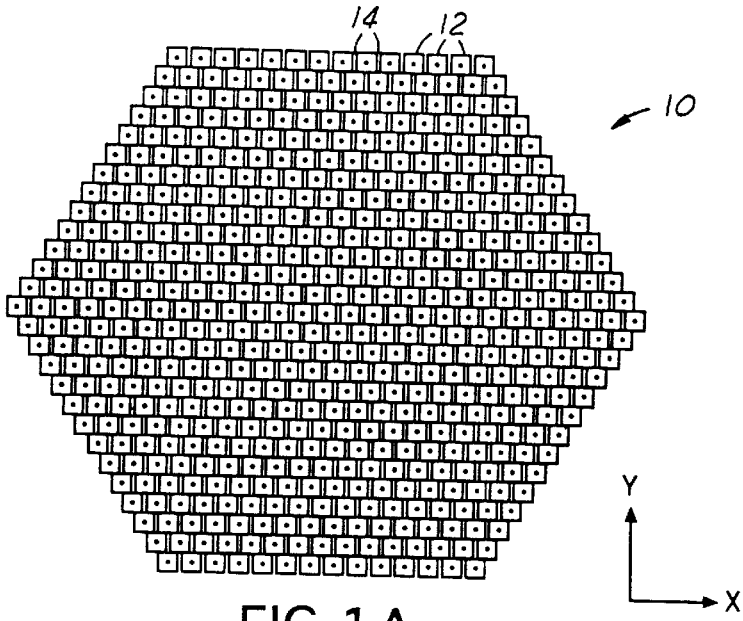
FIG. 1A illustrates square horns arranged in a hexagonal grid for a reconfigurable fixed satellite service array antenna.
Figure 1B:
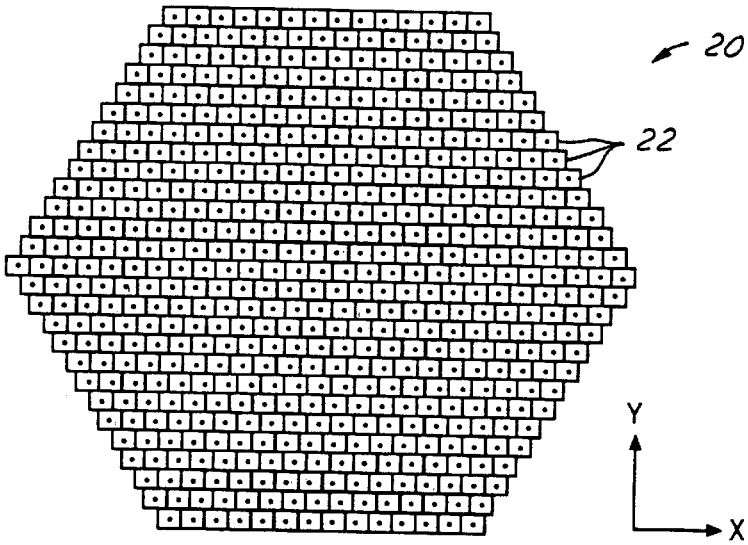
FIG. 1B illustrates rectangular horns arranged in a hexagonal grid for a reconfigurable fixed satellite service array antenna.

Referring now to FIGS. 1A and 1B, hexagonal grid arrangements of horns are shown. FIG. 1A illustrates an array antenna 10 having a plurality of square horns 12 acting as radiating elements. Square horns 12 are arranged in a hexagonal grid arrangement. Gaps 14 are located between square horns 12. FIG. 1B illustrates an array antenna 20 having a plurality of rectangular horns 22 acting as radiating elements. Rectangular horns 22 are also arranged in a hexagonal grid arrangement. Because of gaps 14, array antenna 10 is not as efficient as array antenna 20. The efficiency of array antennas 10 and 20 can be further improved by using multi-mode horns instead of single dominant mode horns.

Figure 2:
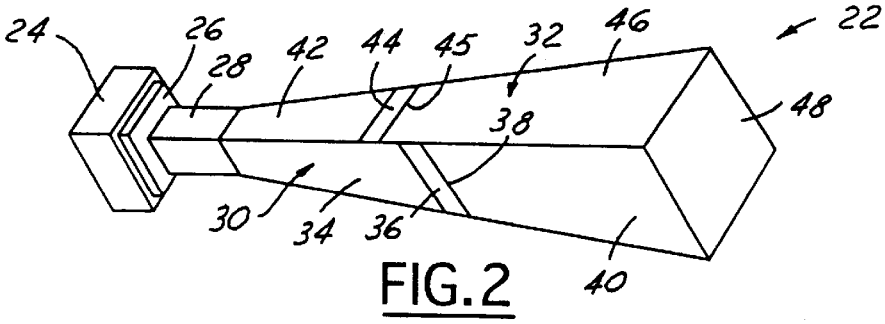
FIG. 2 illustrates a perspective view of a rectangular horn in accordance with a preferred embodiment of the present invention.

Referring now to FIG. 2, a perspective view of a rectangular horn 22 in accordance with the present invention is shown. Rectangular horn 22 includes an orthogonal mode transducer (OMT) 24 connected by a flange 26 to a square waveguide section 28. Rectangular horn 22 includes a vertical plane 30 and a horizontal plane 32. Vertical and horizontal planes 30 and 32 are orthogonal to one another. Vertical plane 30 is referred to as the E-plane. A signal emanating from rectangular horn 22 with its main electric field component parallel with vertical plane 30 will be referred to herein as a vertical polarization signal. Similarly, horizontal plane 32 is referred to as the H-plane. A signal emanating from rectangular horn 22 with its main electric field component parallel with horizontal plane 32 will be referred to herein as a horizontal polarization signal.

Vertical plane 30 includes a flared waveguide section 34 connected to a matching waveguide section 36. A step junction 38 connects matching waveguide section 36 to a phasing section 40. Similarly, horizontal plane 32 includes a flared waveguide section 42 connected to a matching waveguide section 44. A step junction 45 connects matching waveguide section 44 to a phasing section 46. Phasing sections 40 and 46 form an aperture plane 48.

Figure 3:
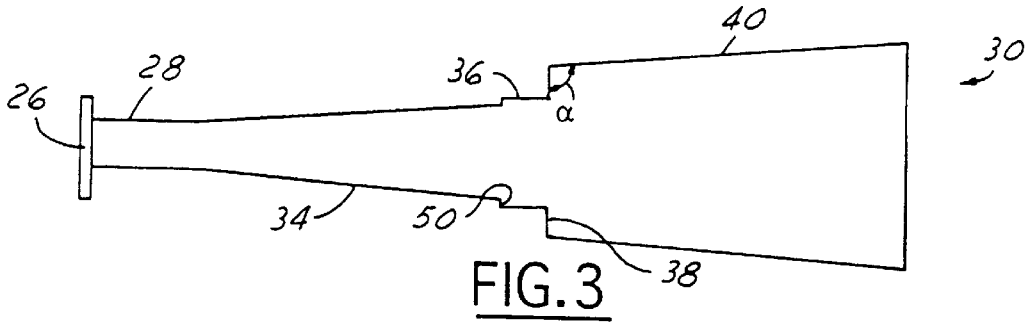
FIG. 3 illustrates a cross-sectional view of the vertical plane of the rectangular horn.
Figure 4:
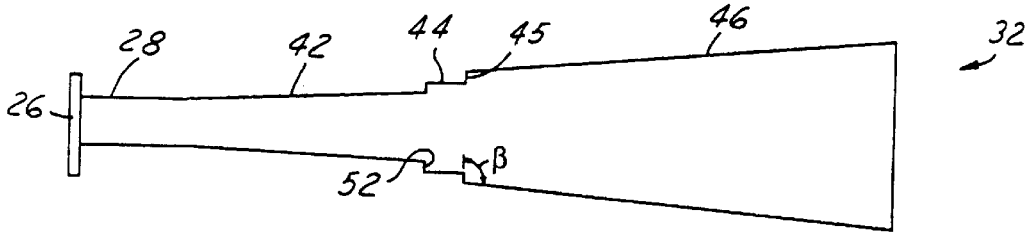
FIG. 4 illustrates a cross-sectional view of the horizontal plane of the rectangular horn.

Referring now to FIGS. 3 and 4 with continual reference to FIG. 2, cross-sectional views of vertical and horizontal planes 30 and 32 of rectangular horn 22 are respectively shown. An advantage of the present invention is that rectangular horn 22 includes respective step junctions 38 and 45 for each of vertical and horizontal planes 30 and 32. Step junctions 38 and 45 support dual-mode signals for both polarizations with each of the vertical and horizontal polarization signals being independent of one another. Step junctions 38 and 45 are located at different axial points along rectangular horn 22 to enhance the horn performance for both polarizations.

In the transmit operation, OMT 24 provides separate orthogonal vertical and horizontal polarization signals to rectangular horn 22. The amplitude and phase of each of the orthogonal polarization signals provided by OMT 24 are independent of one another. The orthogonal polarization signals pass through square waveguide section 28 into respective flared waveguide sections 34 and 42. Each of the orthogonal polarization signals are now dominant $TE_{10}$ mode signals.

The vertical polarization $TE_{10}$ mode signal then passes from flared waveguide section 34 through matching section 36 to step junction 38. Step junction 38 has a selected height extending outward from the interior of rectangular horn 22 such that interaction with the vertical polarization $TE_{10}$ mode signal causes a desired amount of the higher order vertical polarization $TE_{30}$ mode to be generated from the vertical polarization $TE_{10}$ mode signal. Step junction 38 is positioned at an axial length sufficiently far from square waveguide section 28 such that the higher order vertical polarization $TE_{30}$ mode signal is supported, i.e., the cut-off frequency for the $TE_{30}$ mode signal is below the operating frequency.

The amplitude of the vertical polarization $TE_{30}$ mode signal generated is a function of the height of step junction 38. Step junction 38 has no meaningful axial length as shown in FIG. 3. Preferably, the height of step junction 38 is selected such that the ratio of the peak electric field intensity values between the vertical polarization $TE_{10}$ and $TE_{30}$ mode signals is about 3:1. A higher ratio is also desirable, but a lower ratio is undesirable because it requires a larger step height which would generate undesired higher order mode signals such as the $TE_{12}$ and $TM_{12}$ mode signals. These undesired modes make the aperture illumination of rectangular horn 22 more tapered thereby reducing the horn aperture efficiency. By using the smallest possible step height, the amplitude of these undesired mode signals can be kept low such that the impact on the efficiency of rectangular horn 22 is minimal. It has been determined that the ideal ratio of 3:1 yields a maximum efficiency for rectangular horn 22.

The vertical polarization $TE_{10}$ and $TE_{30}$ mode signals then pass through phasing section 40. The vertical polarization $TE_{10}$ and $TE_{30}$ mode signals have different phase velocities as they travel along phasing section 40. Phasing section 40 extends outward from the interior of rectangular horn 22. Preferably, phasing section 40 extends outward at an angle alpha with respect to step junction 38, where the angle alpha preferably falls between the range of greater than 90° and less than 100°. The angle a is the flared angle of phasing section 40. Phasing section 40 also has an axial length which extends from step junction 38 to aperture plane 48. The axial length and the flared angle of phasing section 40 are selected such that the differential phase between the vertical polarization $TE_{10}$ and $TE_{30}$ mode signals is about 180° at the center of aperture plane 48 along vertical plane 30. The out of phase addition of the vertical polarization $TE_{10}$ and $TE_{30}$ mode signals produces a high aperture efficiency for rectangular horn 22. A combined vertical polarization signal consisting of the vertical polarization $TE_{10}$ and $TE_{30}$ mode signals is then transmitted from aperture plane 48 towards a target.

Similarly, the horizontal polarization $TE_{10}$ mode signal then passes from flared waveguide section 42 through matching section 44 to step junction 45. Step junction 45 also has a selected height extending outward from the interior of rectangular horn 22 such that interaction with the horizontal polarization $TE_{10}$ mode signal causes a desired amount of the higher order horizontal polarization $TE_{30}$ mode signal to be generated from the horizontal polarization $TE_{10}$ mode signal. The amplitude of the horizontal polarization $TE_{30}$ mode signal generated is a function of the height of step junction 45. Step junction 45 also has no meaningful axial length as shown in FIG. 3. Preferably, the height of step junction 45 is also selected such that the ratio of the peak electric field intensity values between the horizontal polarization $TE_{10}$ and $TE_{30}$ mode signals is about 3:1.

The horizontal polarization $TE_{10}$ and $TE_{30}$ mode signals then pass through phasing section 46. Phasing section 46 extends outward from the interior of rectangular horn 22. Preferably, phasing section 46 extends outward at an angle beta with respect to step junction 45, where the angle β, the flared angle, also preferably falls between the range of greater than 90° and less than 100°. Phasing section 46 also has an axial length which extends from step junction 45 to aperture plane 48. The axial length and the flared angle of phasing section 45 are selected such that the differential phase between the horizontal polarization $TE_{10}$ and $TE_{30}$ mode signals is about 180° at the center of aperture plane 48. A combined horizontal polarization signal consisting of the horizontal polarization $TE_{10}$ and $TE_{30}$ mode signals is then transmitted from aperture plane 48 towards a target.

The design in vertical and horizontal planes 30 and 32 is different in terms of the axial location of step junctions 38 and 45, the height of the step junctions, and the length of phasing sections 40 and 46. Preferably, the aperture sizes of vertical and horizontal planes 30 and 32 is in the ratio of about 1:0.866 for operation in a frequency range of 10.70 to 12.75 GHz.

Matching sections 36 and 44 are provided in respective vertical and horizontal planes 30 and 32 to provide proper impedance matching of rectangular horn 22 with the free space and therefore minimize the reflection losses. Matching section 36 has an axial length extending between step junction 38 and an input end 50. The axial length of matching section 36 is selected such that the reflections introduced by step junction 38 are cancelled. Similarly, matching section 44 has an axial length extending between step junction 45 and an input end 52. The axial length of matching section 44 is selected such that the reflections introduced by step junction 45 are cancelled.

Figure 5:
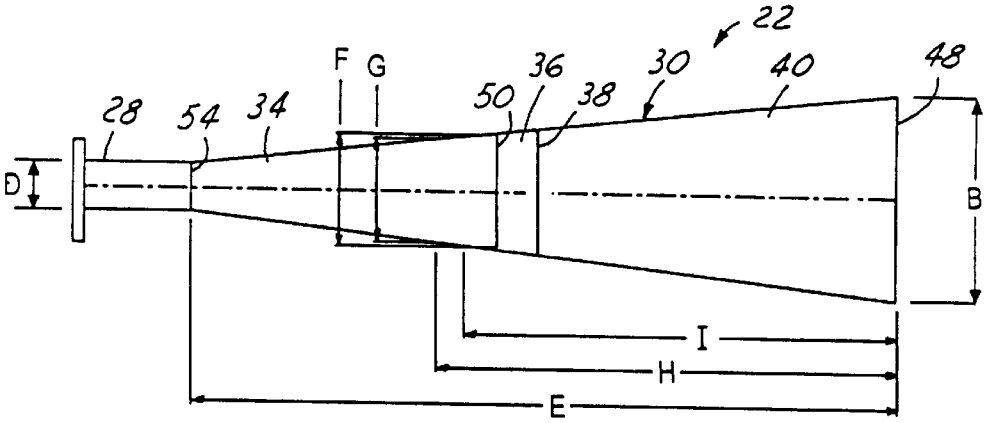
FIG. 5 is a side view along the vertical plane of a rectangular horn having a preferred geometry.
Figure 6:
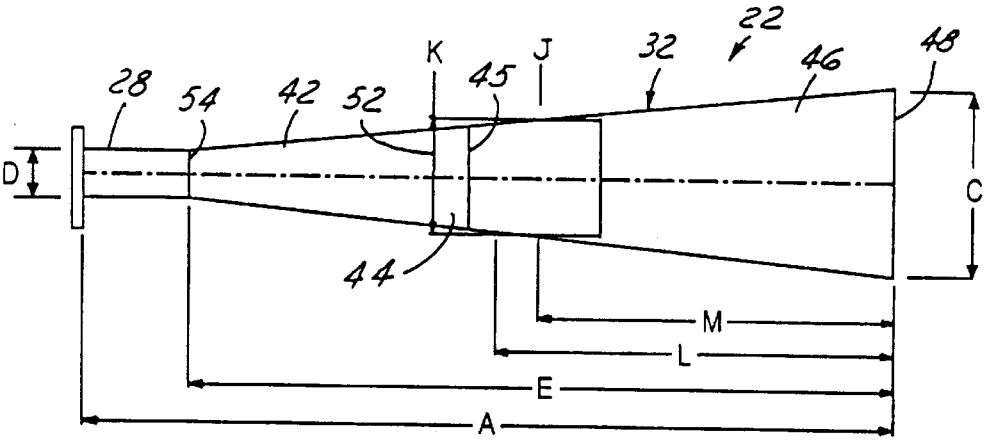
FIG. 6 is a side view along the horizontal plane of the rectangular horn having the preferred geometry.

Referring now to FIGS. 5 and 6 with continual reference to FIGS. 3 and 4, side views of vertical and horizontal planes 30 and 32 illustrating the preferred geometry for operation in the 10.70 to 12.75 GHz frequency band are shown. The axial length of rectangular horn 22 is 11.6 inches (29.46 cm) as designated by line "A". Vertical plane 30 extends 3.09 inches (7.85 cm) across aperture plane 48 as designated by line "B". Horizontal plane 32 extends 2.67 inches (6.78 cm) across aperture plane 48 as designated by line "C". Thus, the aperture sizes of vertical and horizontal planes 30 and 32 is in the ratio of about 1:0.866. Square waveguide section 28 has four sides that are 0.75 inches (1.90 cm) long as designated by line "D". The axial length from square waveguide end 54 to aperture plane 48 is 10.1 inches (25.65 cm) as designated by line "E".

Step junction 45 has a height of 0.093 inches (0.24 cm). Specifically, at its most outward point, step junction 45 extends 1.662 inches (4.22 cm) across horizontal plane 32 from one end to the other end as designated by line "F". At its most inward point, step junction 45 extends 1.569 inches (3.99 cm) across horizontal plane 32 from one end to the other end as designated by line "G". Matching section 44 has an axial length of 0.4 inches (1.02 cm) extending between input end 52 and step junction 45. Specifically, input end 52 is positioned 6.6 inches (16.76 cm) away from aperture plane 48 as designated by line "H". Step junction 45 is positioned 6.2 inches (15.75 cm) away from aperture plane 48 as designated by line "I".

Step junction 38 has a height of 0.075 inches (0.19 cm). At its most outward point, step junction 38 extends 1.71 inches (4.34 cm) across vertical plane 30 from one end to the other end as designated by line "J". At its most inward point, step junction 38 extends 1.635 inches (4.15 cm) across vertical plane 30 from one end to the other end as designated by line "K". Matching section 36 has an axial length of 0.6 inches (1.52 cm) extending between input end 50 and step junction 38. Input end 50 is positioned 5.7 inches (14.48 cm) away from aperture plane 48 as designated by line "L". Step junction 38 is positioned 5.1 inches (12.95 cm) away from aperture plane 48 as designated by line "M".

In essence, the step sizes and locations are selected such that aperture efficiency values of 80% to 85% are achieved over a 20% bandwidth for both polarization signals. The horn geometry shown in FIG. 6 was selected using mode matching software.

Figure 7:
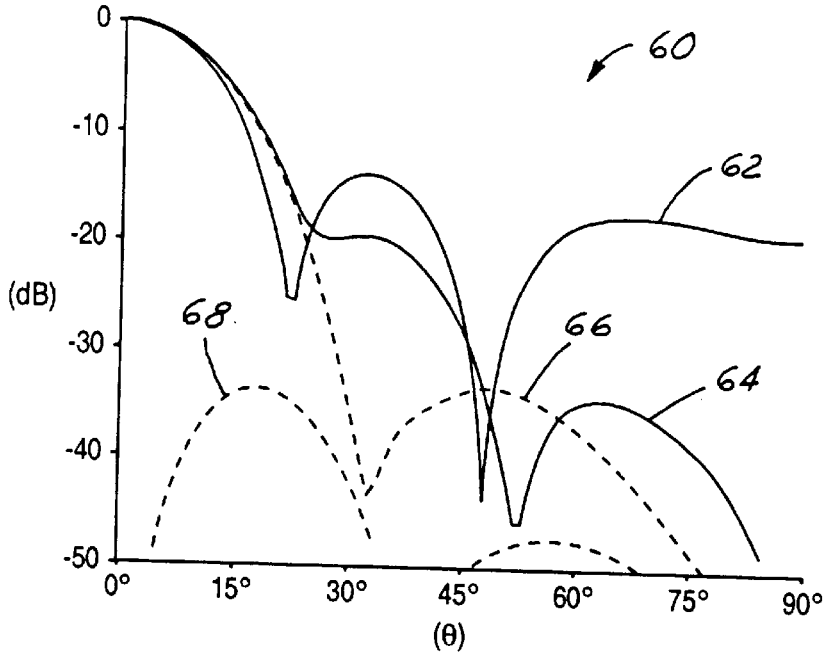
FIG. 7 is a graph illustrating the vertical, horizontal, and diagonal plane radiation patterns for the vertical polarization signal.

Referring now to FIG. 7, a graph 60 illustrating the radiation patterns for the vertical polarization signal as a function of the angle θ for rectangular horn 22 having the preferred geometry is shown. The angle θ is the pointing angle of rectangular horn 22. Graph 60 includes three radiation plots: an E-plane radiation plot 62, an H-plane radiation plot 64, and a diagonal radiation plot 66. Each of radiation plots 62, 64, and 66 are normalized to 0 dB at θ=0. Graph 60 further includes a cross-polar pattern plot 68 in the diagonal plane of rectangular horn 22.

Figure 8:
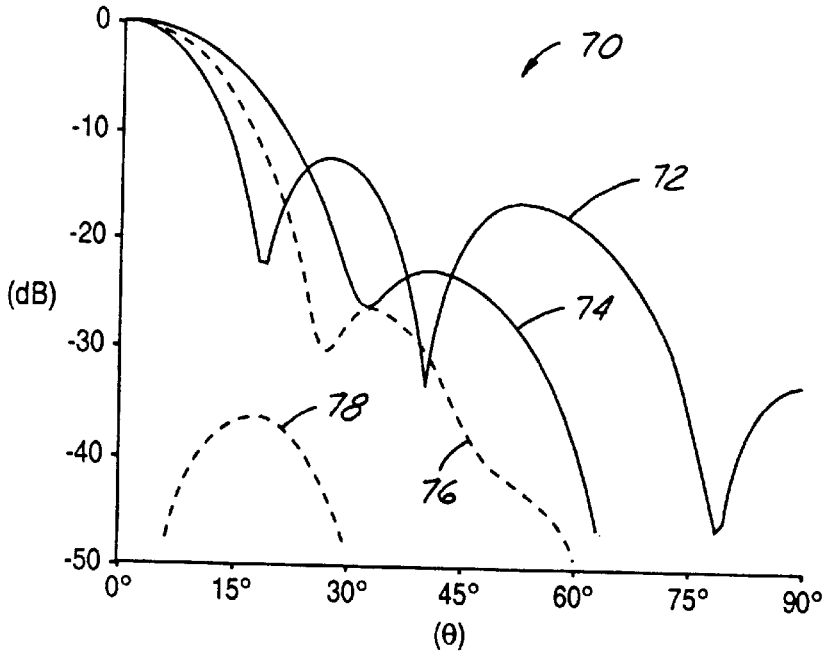
FIG. 8 is a graph illustrating the vertical, horizontal, and diagonal plane radiation patterns for the horizontal polarization signal.

Referring now to FIG. 8, a graph 70 illustrating the radiation patterns for the horizontal polarization signal as a function of the angle θ for rectangular horn 22 having the preferred geometry is shown. Graph 70 includes three radiation plots: an E-plane radiation plot 72, an H-plane radiation plot 74, and a diagonal radiation plot 76. Each of radiation plots 72, 74, and 76 are also normalized to 0 dB at θ=0. Graph 70 further includes a cross-polar pattern plot 78 in the diagonal plane of rectangular horn 22. As shown, the cross-polar levels of rectangular horn 22 over the global field of view of +/−9° is −34 dB relative to the co-polar peak which results in an antenna cross-polar isolation of better than 40 dB for an array antenna employing a plurality of rectangular horns.

Figure 9:
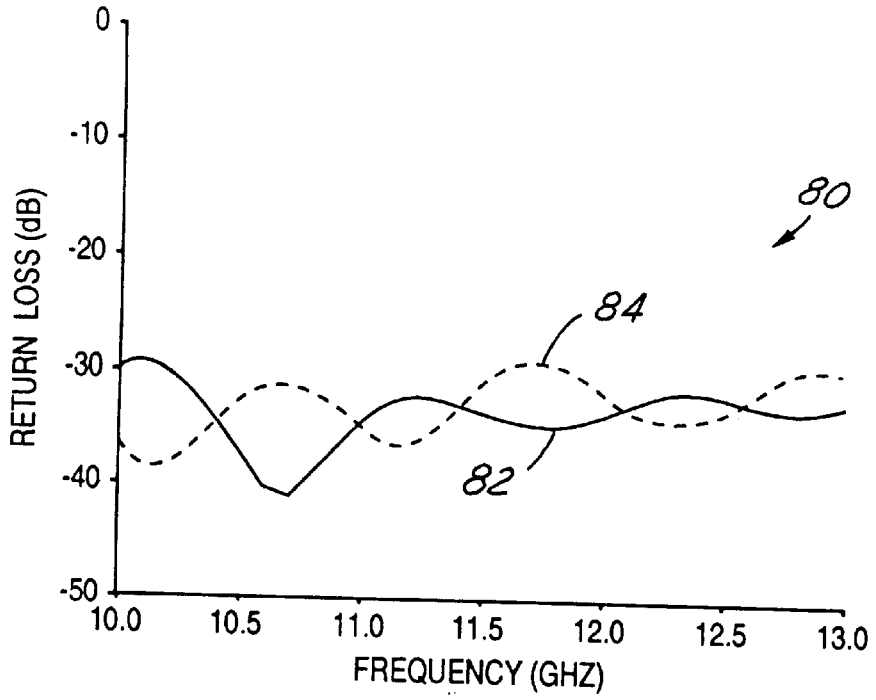
FIG. 9 is a graph illustrating the input return loss as a function of frequency for the vertical and horizontal polarization signals.

Referring now to FIG. 9, a graph 80 illustrating the input return loss as a function of frequency for the vertical and horizontal polarization signals for rectangular horn 22 having the preferred geometry is shown. Graph 80 includes two plots: a vertical polarization signal plot 82 and a horizontal polarization signal plot 84. The swept frequency return loss of rectangular horn 22 for both polarization signals is greater than 29 dB over the 20% bandwidth shown in FIG. 9.

Figure 10:
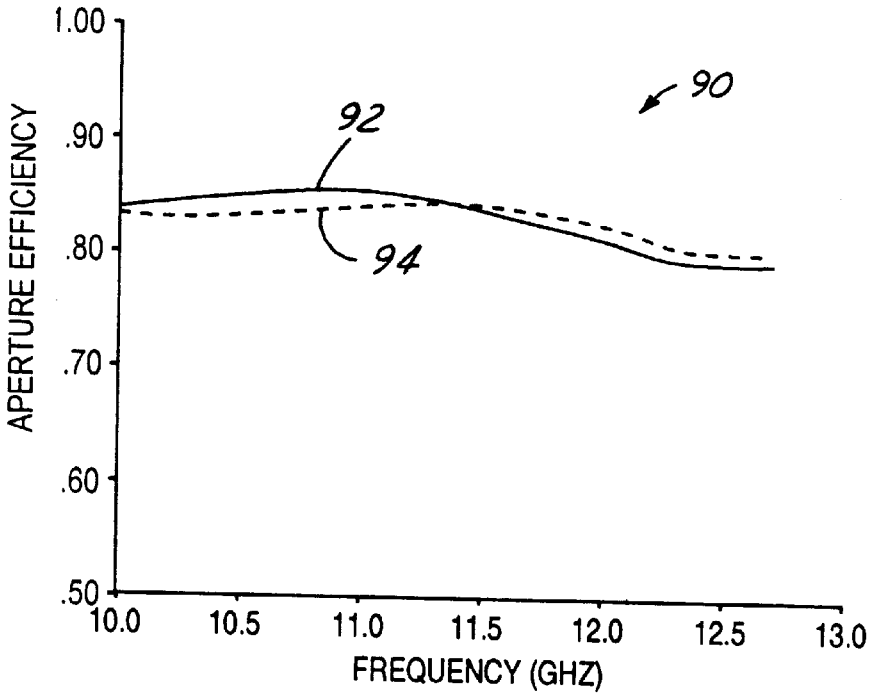
FIG. 10 is a graph illustrating the aperture efficiency as a function of frequency for the vertical and horizontal polarization signals.

Referring now to FIG. 10, a graph 90 illustrating the aperture efficiency as a function of frequency for the vertical and horizontal polarization signals for rectangular horn 22 having the preferred geometry is shown. Graph 90 includes two plots: a vertical polarization signal plot 92 and a horizontal polarization signal plot 94. The aperture efficiency of rectangular horn 22 is better than 80% over the band for both polarization signals. Rectangular horn 22 has a maximum aperture efficiency of about 86% and is optimized towards the lower end of the frequency band where the antenna directivity is typically low. Rectangular horn 22 has about 5% to 10% higher efficiency for both vertical and horizontal polarization signals when compared to typical dominant mode rectangular horns.

In summary, the rectangular horn of the present invention has better electrical performance in terms of efficiency, bandwidth, and return loss as compared to single mode rectangular horns, and is also more efficient than square horns. The rectangular horn of the present invention is ideally suited as the radiating elements arranged in a hexagonal grid layout for array antennas used for dual-linear polarization applications.

Thus it is apparent that there has been provided, in accordance with the present invention, a dual-linearly polarized multi-mode rectangular horn for array antennas that fully satisfies the objects, aims, and advantages set forth above.

While the present invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A dual-linearly polarized multi-mode rectangular horn for an array antenna, the rectangular horn comprising:

a flared waveguide section having first and second pairs of opposed walls, the flared waveguide section providing separate vertical and horizontal polarization $TE_{10}$ mode signals;

a phasing section having first and second pairs of opposed walls extending between first and second ends, the first and second pairs of opposed walls of the phasing section opening outward with respect to the flared waveguide section from the first end and forming an aperture plane at the second end;

a first pair of opposed step junctions each connecting a respective one of the first pair of opposed walls of the phasing section at the first end to a respective one of the first pair of opposed walls of the flared waveguide section, wherein the first pair of step junctions extend orthogonally outward from the flared waveguide section to the phasing section, wherein the first pair of step junctions have a selected height such that interaction with the vertical polarization $TE_{10}$ mode signal causes a desired amount of a vertical polarization $TE_{30}$ mode signal to be generated from the vertical polarization $TE_{10}$ mode signal to form a combined vertical polarization signal, wherein the first pair of step junctions are located at a first axial location between the flared waveguide section and the phasing section such that the differential phase between the vertical polarization $TE_{10}$ and $TE_{30}$ mode signals is 180° at the aperture plane; and a second pair of opposed step junctions each connecting a respective one of the second pair of opposed walls of the phasing section at the first end to a respective one of the second pair of opposed walls of the flared waveguide section, wherein the second pair of step junctions extend orthogonally outward from the flared waveguide section to the phasing section, wherein the second pair of step junctions have a selected height such that interaction with the horizontal polarization $TE_{10}$ mode signal causes a desired amount of a horizontal polarization $TE_{30}$ mode signal to be generated from the horizontal polarization $TE_{10}$ mode signal to form a combined horizontal polarization signal, wherein the second pair of step junctions are located at a second axial location between the flared waveguide section and the phasing section such that the differential phase between the horizontal polarization $TE_{10}$ and $TE_{30}$ mode signals is 180° at the aperture plane;

wherein the phasing section receives the combined vertical and horizontal polarization signals for transmission at the aperture plane.

2. The rectangular horn of claim 1 wherein:

the first and second pairs of step junctions each have a selected height such that the ratio of the peak electric field intensity values of the $TE_{10}$ and $TE_{30}$ mode signals for each of the combined vertical and horizontal polarization signals is 3:1.

3. The rectangular horn of claim 1 wherein:

the first pair of step junctions have a selected height such that the ratio of the peak electric field intensity values of the vertical polarization $TE_{10}$ and $TE_{30}$ mode signals is 3:1.

4. The rectangular horn of claim 1 wherein:

the second pair of step junctions have a selected height such that the ratio of the peak electric field intensity values of the horizontal polarization $TE_{10}$ and $TE_{30}$ mode signals is 3:1.

5. The rectangular horn of claim 1 wherein:

the first and second pairs of step junctions each have a selected height such that the ratio of the peak electric field intensity values of the $TE_{10}$ and $TE_{30}$ mode signals for each of the combined vertical and horizontal polarization signals is 3:1.

6. The rectangular horn of claim 1 further comprising:

a first pair of matching waveguide sections each connecting a respective one of the first pair of opposed walls of the flared waveguide section to a respective one of the first pair of step junctions, and a second pair of matching waveguide sections each connecting a respective one of the second pair of opposed walls of the flared waveguide section to a respective one of the second pair of step junctions.

7. An array antenna for a satellite, the array antenna comprising:

a plurality of dual-linearly polarized multi-mode rectangular horns, each of the rectangular horns including:

a flared waveguide section having first and second pairs of opposed walls, the flared waveguide section providing separate vertical and horizontal polarization $TE_{10}$ mode signals;

a phasing section having first and second pairs of opposed walls extending between first and second ends, the first and second pairs of opposed walls of the phasing section opening outward with respect to the flared waveguide section from the first end and forming an aperture plane at the second end;

a first pair of opposed step junctions each connecting a respective one of the first pair of opposed walls of the phasing section at the first end to a respective one of the first pair of opposed walls of the flared waveguide section, wherein the first pair of step junctions extend orthogonally outward from the flared waveguide section to the phasing section, wherein the first pair of step junctions have a selected height such that interaction with the vertical polarization $TE_{10}$ mode signal causes a desired amount of a vertical polarization $TE_{30}$ mode signal to be generated from the vertical polarization $TE_{10}$ mode signal to form a combined vertical polarization signal, wherein the first pair of step junctions are located at a first axial location between the flared waveguide section and the phasing section such that the differential phase between the vertical polarization $TE_{10}$ and $TE_{30}$ mode signals is 180° at the aperture plane; and a second pair of opposed step junctions each connecting a respective one of the second pair of opposed walls of the phasing section at the first end to a respective one of the second pair of opposed walls of the flared waveguide section, wherein the second pair of step junctions extend orthogonally outward from the flared waveguide section to the phasing section, wherein the second pair of step junctions have a selected height such that interaction with the horizontal polarization $TE_{10}$ mode signal causes a desired amount of a horizontal polarization $TE_{30}$ mode signal is generated from the horizontal polarization $TE_{10}$ mode signal to form a combined horizontal polarization signal, wherein the second pair of step junctions are located at a second axial location between the flared waveguide section and the phasing section such that the differential phase between the horizontal polarization $TE_{10}$ and $TE_{30}$ mode signals is 180° at the aperture plane;

wherein the phasing section receives the combined vertical and horizontal polarization signals for transmission at the aperture plane.

8. The array antenna of claim 7 wherein:

the first and second pairs of step junctions each have a selected height such that the ratio of the peak electric field intensity values of the $TE_{10}$ and $TE_{30}$ mode signals for each of the combined vertical and horizontal polarization signals is 3:1.

9. The array antenna of claim 7 wherein:

the first pair of step junctions have a selected height such that the ratio of the peak electric field intensity values of the vertical polarization $TE_{10}$ and $TE_{30}$ mode signals is 3:1.

10. The array antenna of claim 7 wherein:

the second pair of step junctions have a selected height such that the ratio of the peak electric field intensity values of the horizontal polarization $TE_{10}$ and $TE_{30}$ mode signals is 3:1.

11. The array antenna of claim 7 wherein:

the first and second pairs of step junctions each have a selected height such that the ratio of the peak electric field intensity values of the $TE_{10}$ and $TE_{10}$ mode signals for each of the combined vertical and horizontal polarization signals is 3:1.

12. The rectangular horn of claim 7 further comprising:

a first pair of matching waveguide sections each connecting a respective one of the first pair of opposed walls of the flared waveguide section to a respective one of the first pair of step junctions, and a second pair of matching waveguide sections each connecting a respective one of the second pair of opposed walls of the flared waveguide section to a respective one of the second pair of step junctions.

* * * * *